US007484726B2

(12) United States Patent
Hashimoto et al.

(10) Patent No.: US 7,484,726 B2
(45) Date of Patent: Feb. 3, 2009

(54) SHEET FEEDING DEVICE

(75) Inventors: Susumu Hashimoto, Katsuragi (JP); Hidetoshi Kaneko, Yamatokoriyama (JP); Toshiki Ohgita, Shiki-gun (JP); Jinichi Nagata, Osaka (JP); Yoshitaka Matsumoto, Shijonawate (JP); Hideo Yoshikawa, Yamatokoriyama (JP); Kouzou Yamaguchi, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 156 days.

(21) Appl. No.: 11/455,100

(22) Filed: Jun. 19, 2006

(65) Prior Publication Data

US 2006/0284361 A1 Dec. 21, 2006

(30) Foreign Application Priority Data

Jun. 20, 2005 (JP) ..... 2005-179277

(51) Int. Cl.
*B65H 1/22* (2006.01)

(52) U.S. Cl. ..... 271/164; 271/162; 16/19

(58) Field of Classification Search ..... 271/164, 271/162; 16/32, 18 R, 19, 33, 44, 29
See application file for complete search history.

(56) References Cited

U.S. PATENT DOCUMENTS

| | | | | |
|---|---|---|---|---|
| 1,008,749 | A * | 11/1911 | Stahl | 280/84 |
| 2,472,686 | A * | 6/1949 | Snyder | 16/44 |
| 4,397,062 | A * | 8/1983 | Huang | 16/33 |
| 4,748,715 | A * | 6/1988 | Rice | 16/19 |
| 5,014,391 | A * | 5/1991 | Schulte | 16/35 R |
| 5,630,578 | A * | 5/1997 | Naramore et al. | 270/58.08 |
| 6,279,199 | B1 * | 8/2001 | Plate | 16/19 |
| 6,308,026 | B1 * | 10/2001 | Kouchi | 399/110 |
| 6,499,184 | B2 * | 12/2002 | Plate | 16/44 |
| 2003/0218295 | A1 * | 11/2003 | Hatakeyama | 271/162 |
| 2004/0226135 | A1 * | 11/2004 | Wang | 16/44 |

FOREIGN PATENT DOCUMENTS

| | | |
|---|---|---|
| JP | 5-193766 A | 8/1993 |
| JP | 11-79430 A | 3/1999 |

* cited by examiner

*Primary Examiner*—Patrick H Mackey
*Assistant Examiner*—Jeremy Severson
(74) *Attorney, Agent, or Firm*—Birch, Stewart, Kolasch & Birch, LLP

(57) ABSTRACT

A sheet feeding device is adapted to be placed beside a sheet processing apparatus by being lifted on a side close to the sheet processing apparatus for engagement with the sheet processing apparatus. The sheet feeding device includes a housing, casters, and an elastic member. The housing stores therein sheets to be supplied to the sheet processing apparatus. Provided for supporting the housing, the casters are mounted on a bottom portion of the housing and include a first caster and a second caster. The first caster is located close to the sheet processing apparatus so as to be movable upward and downward. The second caster is located far from the sheet processing apparatus. The elastic member applies a downward force to the first caster.

8 Claims, 7 Drawing Sheets

PRIOR ART

SHEET FEEDING DEVICE

CROSS REFERENCE

This Nonprovisional application claims priority under 35 U.S.C. § 119(a) on Patent Application No. 2005-179277 filed in Japan on Jun. 20, 2005, the entire contents of which are hereby incorporated by reference.

BACKGROUND OF THE INVENTION

The present invention relates to sheet feeding devices, such as large capacity cassettes (hereinafter merely referred to as LCCs), adapted, for use with sheet processing apparatus such as image forming apparatus, to store therein a large number of sheets to be fed into the apparatus.

Conventionally, sheet feeding devices are placed beside sheet processing apparatus and store therein sheets of a size that is most frequently used in the apparatus. FIG. 1 is a schematic front cross-sectional view of a conventional sheet feeding device 200 as disclosed in JP H05-193766. The device 200 has a housing 201, and casters 202 and 203 for supporting the housing 201. The casters 202 and 203 are mounted on a bottom surface of the housing 201.

The device 200 has an engaging member 204 on a side surface close to a sheet processing apparatus 300. When the device 200 is to be placed beside the apparatus 300, the device 200 is lifted on a side close to the apparatus 100, and the engaging member 204 is brought into engagement with an engaging member 301 provided on the apparatus 300 so that a sheet output slit 205 provided in the device 200 is rendered level with a sheet receiving section 302 provided in the apparatus 300. At the time, the caster 202, which is positioned closer to the apparatus 300, is lifted by 3 mm to 5 mm from the floor.

The caster 203, which is positioned farther from the apparatus 300, is rendered adjustable in height by an adjustment screw or the like. After placement of the device 200 beside the apparatus 300, the caster 203 is adjusted in height so that the device 200 is leveled.

Even after leveling of the device 200, however, the caster 202 remains lifted from the floor.

When the apparatus 300 and the device 200 are activated with the caster 202 off the floor, vibration of the apparatus 300 is more likely to be transmitted to the device 200, resulting in a higher frequency of sheet feeding error or sheet transporting error in the device 200.

In light of the foregoing, a feature of the invention is to provide a sheet feeding device that prevents vibration transmission, thereby allowing a reduced frequency of sheet feeding error or sheet transport error.

SUMMARY OF THE INVENTION

According to an aspect of the invention, a sheet feeding device is adapted to be placed beside a sheet processing apparatus by being lifted on a side close to the sheet processing apparatus for engagement with the sheet processing apparatus. The sheet feeding device includes a housing, casters, and an elastic member. The housing stores therein sheets to be supplied to the sheet processing apparatus. The casters are provided for supporting the housing. The casters are mounted on a bottom portion of the housing and include a first caster and a second caster. The first caster is located close to the sheet processing apparatus so as to be movable upward and downward. The second caster is located far from the sheet processing apparatus. The elastic member applies a downward force to the first caster.

In this aspect of the invention, the housing is supported by the casters including the first and second casters. When the sheet feeding device is to be placed beside the sheet processing apparatus, the device is lifted on the side close to the apparatus for engagement with the apparatus, with the first caster kept in contact with the floor, instead of being lifted thereoff, because of the downward force applied by the elastic member.

According to another aspect of the invention, the first caster has a roller and a support. The roller is rotatably supported by the support. The support is mounted so as to be pivotable within a predetermined range around a pivot shaft that is mounted on the housing. The elastic member applies a downward force to the support.

In this aspect of the invention, the roller is rotatably supported by the support, and the pivot shaft for the support is rotatably mounted on the housing. Such a force is applied to the support as to pivot the support downward around the pivot shaft. When the sheet feeding device is lifted for engagement with the sheet processing apparatus, thus, the roller is kept in contact with the floor, instead of being lifted thereoff.

According to another aspect of the invention, the sheet feeding device further includes an adjusting member. The adjusting member is provided for fixing a vertical position of the support.

In this aspect of the invention, the adjusting member allows the support to be secured to the housing, thereby fixing level of the roller with respect to the housing, after engagement of the sheet feeding device with the sheet processing apparatus.

According to another aspect of the invention, the support has a slit of vertically elongated shape. The housing has a screw hole to face the slit, for a screw for securing the support to the housing to be screwed thereinto through the slit.

In this aspect of the invention, the screw is put through the slit and screwed into the screw hole in order to secure the support to the housing, thereby fixing level of the roller with respect to the housing.

DETAILED DESCRIPTION OF THE INVENTION

Figure 1:
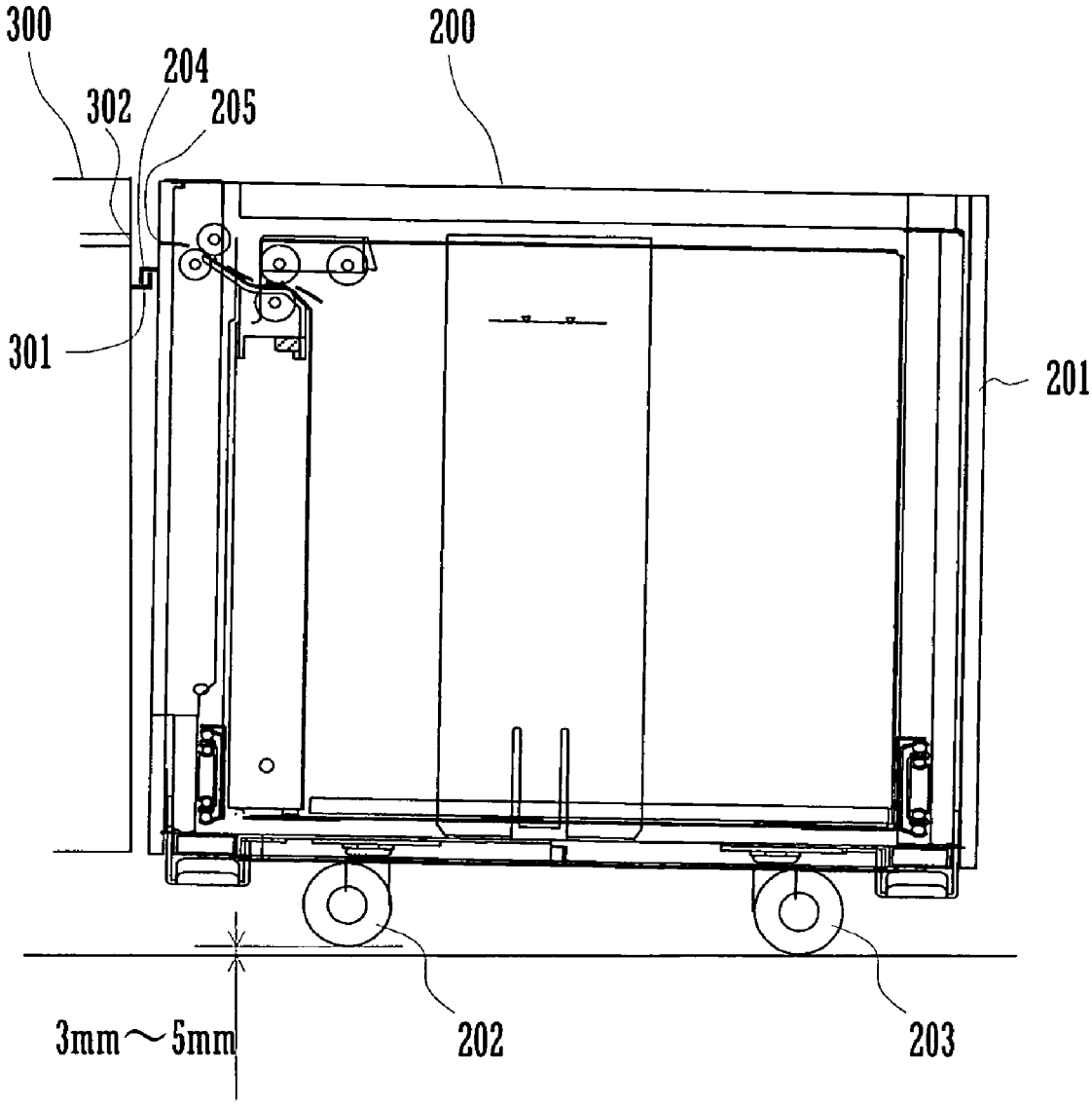
FIG. 1 is a schematic front cross-sectional view illustrating a conventional sheet feeding device.
Figure 2:
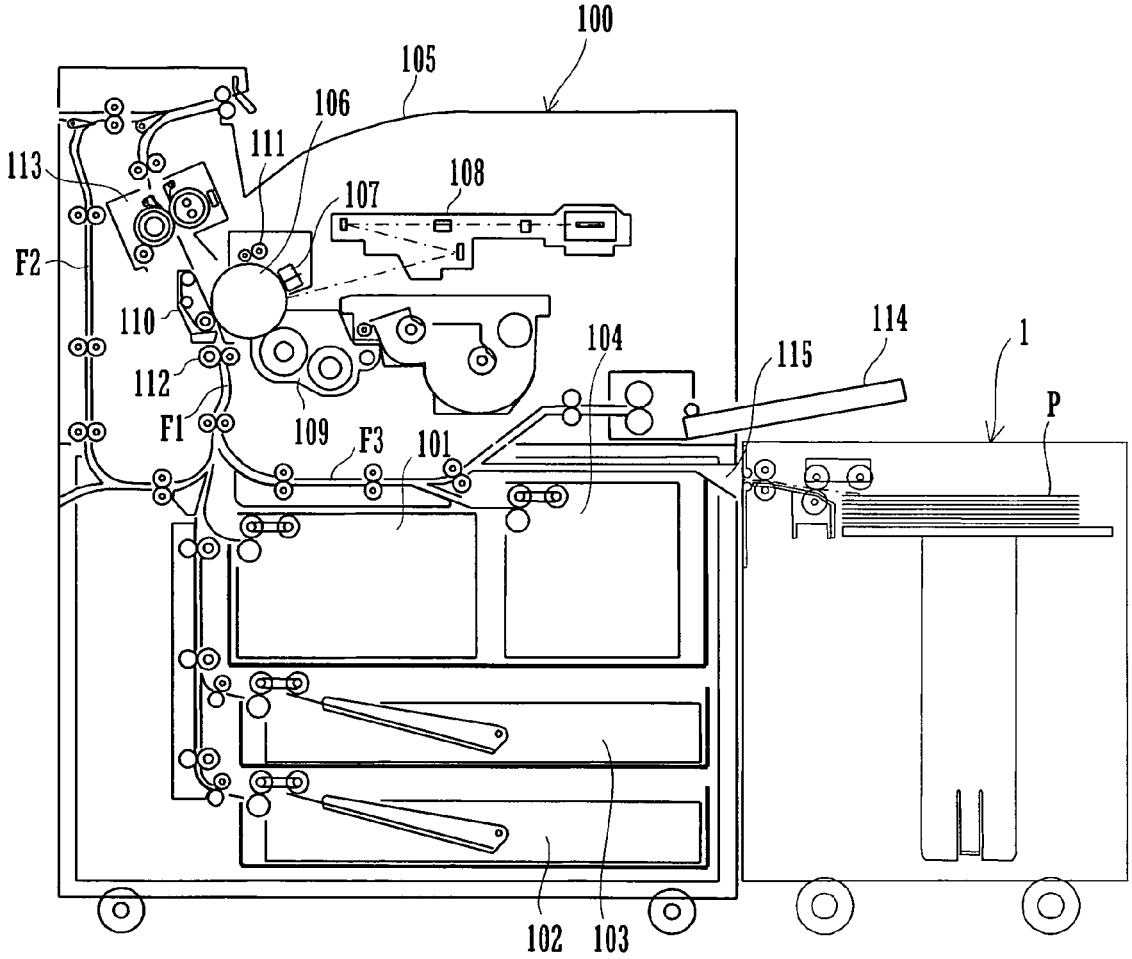
FIG. 2 is a schematic cross-sectional view illustrating an image forming apparatus as a sheet processing apparatus into which an LCC according to an embodiment of the invention is to feed sheets.

Referring to the accompanying drawings, preferred embodiments of the invention are described below. Referring to FIG. 2, the sheet feeding device according to a first embodiment of the invention, such as an LCC 1, is placed beside a sheet processing device such as an image forming apparatus 100. Instead of the single LCC 1 in the present embodiment, a plurality of LCCs may be arranged in alignment with one another. The LCC 1 feeds a sheet of paper or another material such as OHP film into the apparatus 100.

The apparatus 100 forms an image on the sheet by performing an electrophotographic image forming process. In a bottom portion and a top portion thereof, the apparatus 100 has sheet cassettes 101, 102, 103, and 104 and a sheet output tray 105, respectively. A sheet transport path F1 is provided so as to lead from the cassettes 101 to 103 to the sheet output tray 105. A photoreceptor drum 106 is positioned close to the path F1. Around the drum 106, there are arranged a charging device 107, an optical scanning unit 108, a developing unit 109, a transferring device 110, a cleaning unit 111, and the like.

Registration rollers 112 are provided upstream of the drum 106 along the path F1. The rollers 112 feed a sheet to a transfer area that is located between the drum 106 and the device 110, in synchronization with rotation of the drum 106. A fusing device 113 is provided downstream of the drum 106 along the path F1.

The device 107 applies a predetermined level of electrostatic charge to a circumferential surface of the drum 106. The unit 108 forms an electrostatic latent image on the circumferential surface of the drum 106 based on image data that is input externally.

The unit 109 supplies toner to the circumferential surface and develops the electrostatic latent image into a toner image. The device 110 transfers the toner image from the circumferential surface to a sheet. Then, the device 111 fixes the toner image onto the sheet. The sheet with the toner image fixed thereto is output to the tray 105. The unit 111 removes and collects residual toner that remains on the circumferential surface after the transfer operation is completed.

The apparatus 100 is also provided with a switchback transport path F2 and a sheet transport path F3. In a duplex image forming process in which an image is formed on each side of a sheet, the sheet with an image formed on a first side is transported on the path F2 to the transfer area with the first side and a second side reversed.

The path F3 extends approximately horizontally so as to join, at one end, the path F1 at an upstream point of the rollers 112 and be divided, at the other end, to lead to each of the cassette 104, a manual feeding tray 114, and a sheet receiving section 115. The tray 114 is provided on a side surface of the apparatus 100 in order to feed sheets of various sizes. The section 115 is provided for receiving sheets fed from the LCC 1. On the path F3, sheets fed from each of the cassette 104, the tray 114, and the section 115 are transported.

Figure 3:
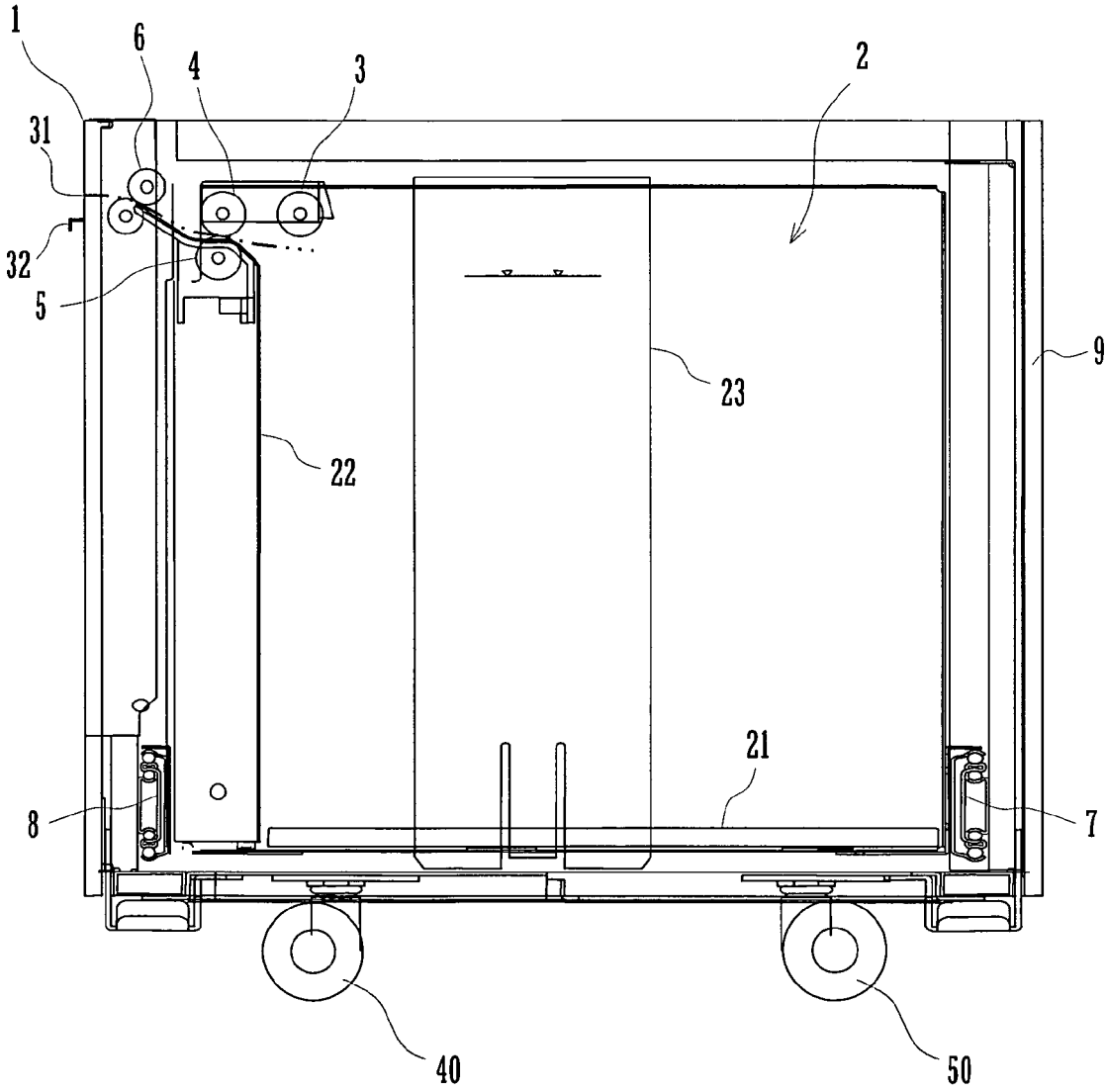
FIG. 3 is a schematic front cross-sectional view illustrating the LCC.

Referring to FIG. 3, the LCC 1 includes a sheet stacker 2, a pick-up roller 3, a feeding roller 4, a reversing roller 5, transporting rollers 6, a housing 9 for accommodating the foregoing components, casters for supporting the housing 9, and an engaging member 32.

In the present embodiment, there are provided four casters. It is to be noted that the number of casters includes, but is not limited to, four. The four casters are classified into two groups: a first group of two casters 40 and a second group of two casters 50, hereinafter referred to merely as the first casters 40 and the second casters 50, respectively. With the LCC 1 placed beside the apparatus 100, the first casters 40 are located closer to the apparatus 100, and the second casters 50 are located farther from the apparatus 100.

The stacker 2 has a stacking plate 21, a front guiding plate 22, side guiding plates 23 and 24, and a rear guiding plate. The side guiding plate 24 and the rear guiding plate are not shown in the figure. Held in a horizontal position, the plate 21 is provided for a plurality of sheets to be stacked thereon. The sheets as stacked are positioned by the front guiding plate 22, the side guiding plates 23 and 24, and the rear guiding plate.

The roller 3 is supported pivotably between an upper position and a lower position about a rotary shaft for the roller 4. The roller 3 comes into contact with a top one of sheets stacked on the plate 21, at a sheet feeding position. The roller 3 is then rotated to pick up and lead the top sheet between the rollers 4 and 5.

The rollers 4 and 5 are both rotated clockwise in FIG. 3, thereby allowing passage of the sheet therebetween. In a case where the roller 3 picks up multiple sheets at a time and leads the sheets between the rollers 4 and 5, only a top one of the sheets comes into contact with the roller 4 and is led to the transporting rollers 6. The top sheet is then output through a sheet output slit 31 and fed into the apparatus 100. The rest of the sheets picked up by the roller 3 are returned to the plate 21 by the roller 5.

The LCC 1 has a capacity of a large number of sheets (approximately 5,000 sheets in the present embodiment) of various sizes such as of A3, B4, A4, and B5.

On the plate 21, thus, the plates 23 and 24 are rendered movable within a predetermined range from frontward to rearward, and vice versa, of the LCC 1. More specifically, the plates 23 and 24 are rendered movable in two opposite directions perpendicular to a sheet feeding direction. Movement of one of the plates 23 and 24 in one of the two directions is transmitted to the other, so that the other one is moved in the other direction. Accordingly, sheets stacked on the plate 21 are positioned approximately at the center of the plate 21 along the opposite directions. In addition, the rear guiding plate is rendered movable within a predetermined range from side to side of the LCC 1, i.e., along the sheet feeding direction.

The stacker 2 has a lifting motor in the rear side surface. Rotation of the lifting motor is transmitted through wire, so that the plate 21 is lifted up and down along a not-shown guiding shaft while being held in a horizontal position. Inside the LCC 1, there are provided slide rail assemblies 7 and 8. Each of the assemblies 7 and 8 has its components mounted on an inner side surface of the housing 9 and on an outer side surface of the stacker 2 so that the components face each other.

The assemblies 7 and 8 allow the stacker 2 to be detachably housed in the housing 9. The stacker 2 is movable between a housed position and an exposed position. In the housed position, the stacker 2 is housed, and the plate 21 is concealed, in the housing 9. In the exposed position, the entire plate 21 is exposed at the front of the housing 9.

Figure 4:
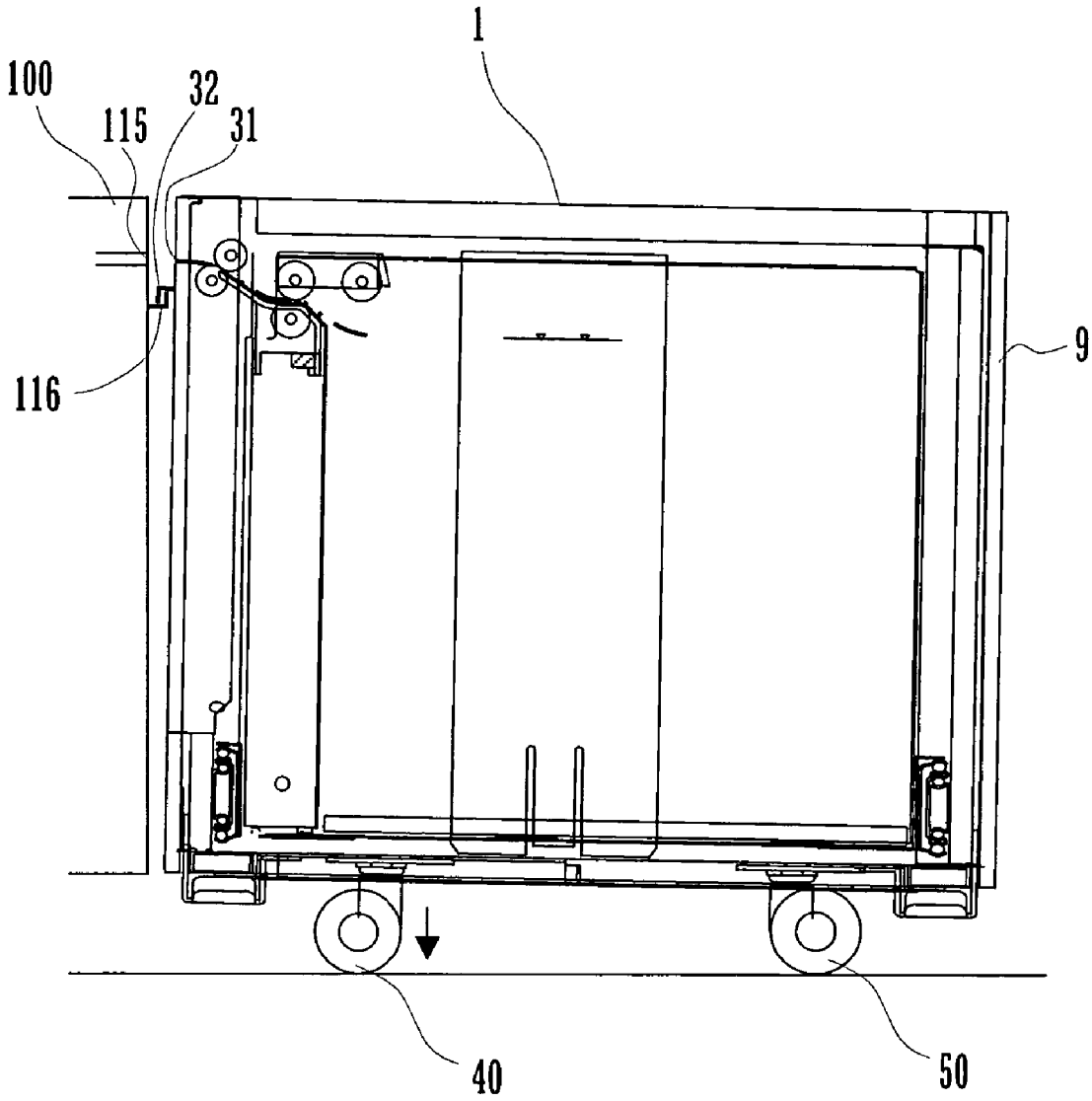
FIG. 4 is a schematic front cross-sectional view illustrating the LCC as placed beside the image forming apparatus.

FIG. 4 is a schematic front cross-sectional view illustrating the LCC 1 as placed beside the apparatus 100.

When the LCC 1 is to be placed beside the apparatus 100, the engaging member 32 is brought into engagement with an engaging member 116 provided on the apparatus 100. Thus, the slit 31 is leveled with the sheet receiving section 115.

Figure 5:
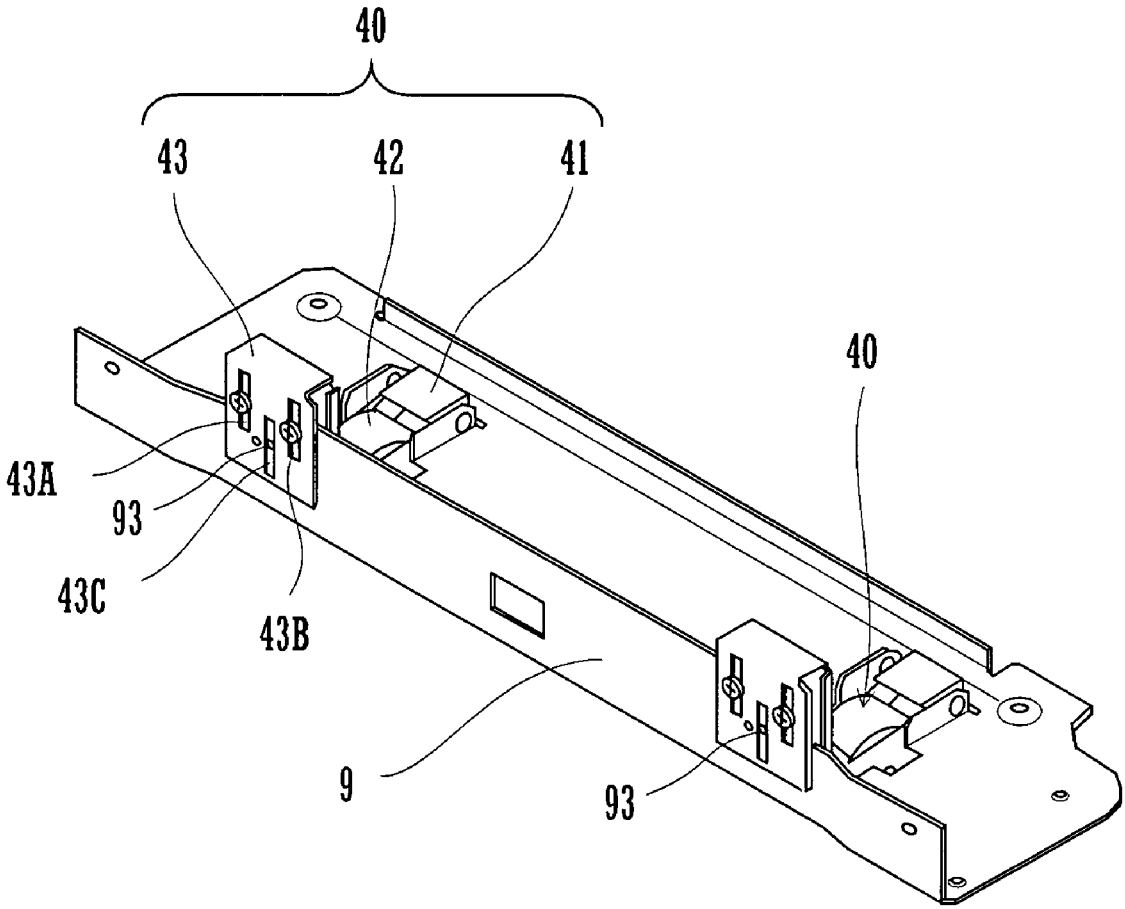
FIG. 5 is a perspective view illustrating first casters mounted on a housing.
Figure 6:
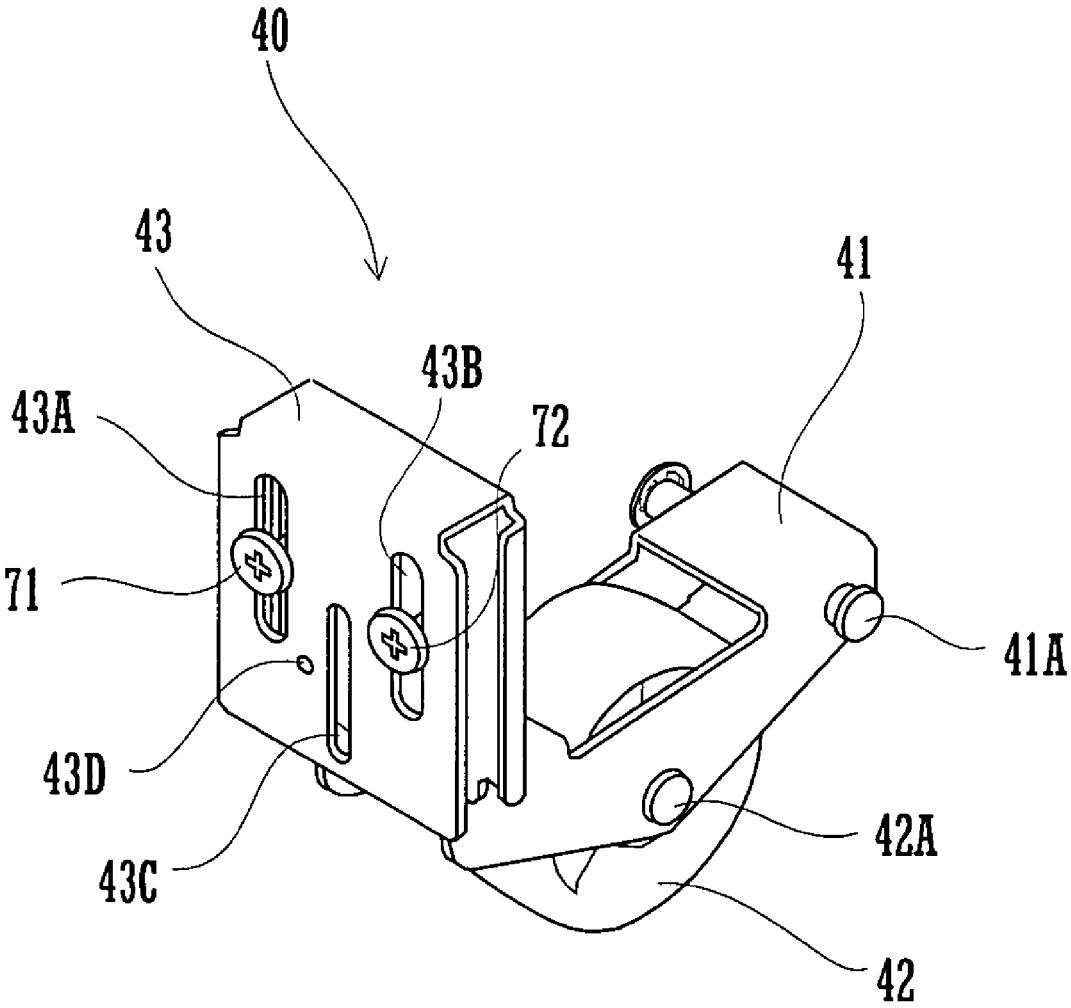
FIG. 6 is an enlarged perspective view illustrating one of the first casters.
Figure 7:
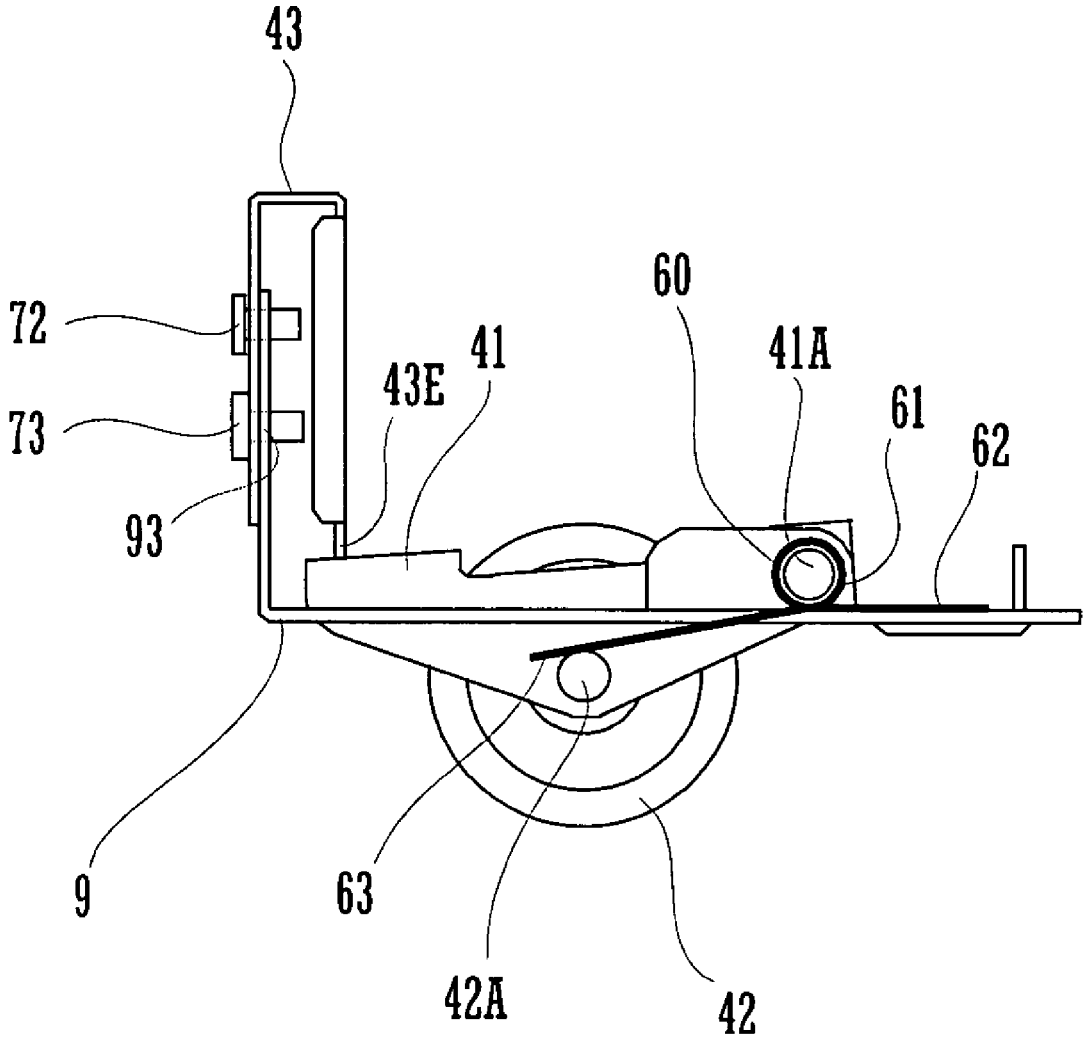
FIG. 7 is a front view illustrating the first casters mounted on the housing.

Referring to FIGS. 5 to 7, each of the first casters 40 has a support 41 and a roller 42. The support 41 has a pivot shaft 41A on a first end and a securing portion 43 on a second end. The roller 42 is rotatably mounted on a shaft 42A. The shaft 42A is installed between the first and second ends of the support 41.

From a front view, the portion 43 is generally of a hollow, inverted U-shape. The portion 43 has: slits 43A and 43B for securing the caster 40 to the housing 9; a slit 43C for adjusting level of the roller 42 with respect to the housing 9; and a hole 43D for indicating a vertical center point of the slit 43C. Each of the slits 43A to 43C is of a vertically elongated shape. The slit 43C corresponds to the slit according to the invention.

The shaft 41A, which is rotatably mounted to the housing 9, renders the support 41 pivotable between an upper position and a lower position around the shaft 41A. A torsion coil spring 60 has a coil portion 61 mounted around the shaft 41A. The spring 60 is fixed at a first end 62 to the housing 9 and at a second end 63 to the shaft 42A. Thus, the spring 60 applies, to the support 41, such an elastic force as to pivot the support 41 downward around the shaft 41A. The spring 60 corresponds to the elastic member according to the invention.

With the plate 21 having no sheet stacked thereon, the engaging member 32 is brought into engagement with the engaging member 116. In the engaging operation, the LCC 1 is lifted on a side close to the apparatus 100, with the roller 42 kept in contact with the floor because of the elastic force applied by the spring 60.

The portion 43 holds part of the housing 9 in a hollow within the U-shape. The housing 9 has two female-threaded holes to face the slits 43A and 43B, respectively. A screw 71 is put through the slit 43A and screwed into a corresponding one of the female-threaded holes. In a similar manner, a screw 72 is put through the slit 43B and screwed into the other hole.

The screws 71 and 72 allow the portion 43 to be secured to the housing 9 with a force that is strong enough to prevent the portion 43 from becoming detached from the housing 9, but weaker than the elastic force applied by the spring 60. Because of the weak fastening forces thereof, the screws 71 and 72 allow the first caster 40 to be moved upward and downward.

When the LCC 1 is to be placed beside the apparatus 100, level of the roller 42 with respect to the housing 9 is fixed as described below. The housing 9 has a threaded hole 93 to face the slit 43C. The engaging member 32 is engaged with the engaging member 116, with the roller 42 kept in contact with the floor, and a screw 73 is put through the slit 43C and screwed into the hole 93. Tightening the screw 73 allows the portion 43 to be tightly secured to the housing 9, thereby fixing level of the roller 42 with respect to the housing 9. The slit 43C, the hole 93, and the screw 73 collectively correspond to the adjusting member according to the invention.

The hole 43D is provided at such a position as to indicate the vertical center point of the slit 43C. Thus, level of the roller 42 with respect to the housing 9 is easily checked through checking of level of the hole 43D with respect to the hole 93.

A covering for the housing 9 has a slit, similar in shape and size to the slit 43C, to face the slit 43C. This slit allows the screw 73 to be put through the slit 43C and turned into the hole 93, from outside the covering.

The LCC 1 as thus described allows the roller 42 to be kept in contact with the floor, without being lifted, by the elastic force applied by the spring 60, even when the engaging member 32 is brought into engagement with the engaging member 116 so that the sheet output slit 31 is leveled with the sheet receiving section 115. This configuration inhibits transmission of vibration from the apparatus 100 to the LCC 1. Therefore, this configuration allows a reduced frequency of sheet feeding error or sheet transport error in the LCC 1.

Also, since a predetermined amount of force is applied to keep the roller 42 in contact with the floor, the housing 9 is supported in a stable manner by the first casters 40 as well as by the second casters 50. Moreover, since level of the roller 42 with respect to the housing 9 is fixed with the roller 42 kept in contact with the floor, the housing 9 is supported in a more stable manner.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet feeding device adapted to be placed beside a sheet processing apparatus by being lifted on a side close to the sheet processing apparatus for engagement with the sheet processing apparatus, the sheet feeding device comprising:

a housing for storing sheets to be supplied to the sheet processing apparatus;

casters for supporting the housing, the casters being mounted on a bottom portion of the housing and including a first caster and a second caster, the first caster being located close to the sheet processing apparatus so as to be movable upward and downward, the second caster being located far from the sheet processing apparatus, wherein the first caster has: a roller; and a support for rotatably supporting the roller, the support being mounted so as to be pivotable within a predetermined range around a pivot shaft that is mounted on the housing, wherein the support has a slit of vertically elongated shape, and wherein the housing has a screw hole to face the slit, for a screw for securing the support to the housing to be screwed thereinto through the slit;

a torsion spring for applying a downward force to the first caster, wherein the torsion spring is mounted horizontally, wherein the torsion spring applies a downward force to the support; and an adjusting member for fixing a vertical position of the support.

2. The sheet feeding device according to claim 1, wherein the first caster includes a roller being rotatably mounted on a roller shaft and wherein the torsion spring is mounted on a pivot shaft which is rotatably mounted to the housing.

3. The sheet feeding device according to claim 2, wherein the pivot shaft is parallel to the roller shaft.

4. The sheet feeding device according to claim 1, further comprising; a pivot shaft which is rotatably mounted to the housing, wherein the torsion spring has a coil portion mounted around the pivot shaft.

5. The sheet feeding device according to claim 4, wherein a first end of the torsion spring is fixed to the housing.

6. The sheet feeding device according to claim 5, the first caster includes a roller being rotatably mounted on a roller shaft.

7. The sheet feeding device according to claim 6, wherein a second end of the torsion spring is fixed to the roller.

8. The sheet feeding device according to claim 7, wherein the second end of the torsion spring is fixed to the roller shaft of the roller.

* * * * *